US009111743B2

(12) United States Patent
Wang et al.

(10) Patent No.: US 9,111,743 B2
(45) Date of Patent: Aug. 18, 2015

(54) PREHEATING CIRCUIT FOR ELECTRONIC BALLAST

(71) Applicant: GENERAL ELECTRIC COMPANY, Schenectady, NY (US)

(72) Inventors: Fanbin Wang, Shanghai (CN); Youmin Zhang, Shanghai (CN); Hongbin Wei, Shanghai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/070,641

(22) Filed: Nov. 4, 2013

(65) Prior Publication Data

US 2014/0152179 A1 Jun. 5, 2014

(30) Foreign Application Priority Data

Nov. 30, 2012 (CN) ..... 2012 1 0502418

(51) Int. Cl.
*H05B 37/00* (2006.01)
*H01J 61/52* (2006.01)
*H05B 41/14* (2006.01)

(52) U.S. Cl.
CPC ..... *H01J 61/526* (2013.01); *H05B 41/14* (2013.01)

(58) Field of Classification Search
CPC ..... H01J 61/526; H01J 1/135; H01J 37/24; H01J 37/242; H01J 37/241; H01J 61/00; H01J 61/523; H01J 61/52; H05B 37/00; H05B 37/02; H05B 41/00; H05B 41/02; H05B 41/14
USPC ..... 315/94, 102, 107, 104, 105, 106, 101, 315/224, 219, 307, 308, DIG. 5, DIG. 7
See application file for complete search history.

(56) References Cited

U.S. PATENT DOCUMENTS

| | | | | |
|---|---|---|---|---|
| 5,789,866 | A | 8/1998 | Keith et al. | |
| 6,504,313 | B1 | 1/2003 | Shen | |
| 6,664,742 | B2 | 12/2003 | Venkatraman et al. | |
| 7,176,639 | B2 | 2/2007 | Hu et al. | |
| 7,187,132 | B2 | 3/2007 | Bakre | |
| 7,193,368 | B2 | 3/2007 | Chen et al. | |
| 2006/0055339 | A1 * | 3/2006 | Rudolph | 315/247 |
| 2009/0256481 | A1 | 10/2009 | Kalugumalai et al. | |
| 2010/0109548 | A1 * | 5/2010 | Matsuda | 315/279 |

* cited by examiner

*Primary Examiner* — David H Vu
(74) *Attorney, Agent, or Firm* — GE Global Patent Operation; Peter T. DiMauro

(57) ABSTRACT

A filament preheat module for preheating a filament of a lamp powered by a power circuit including an inverter, the inverter comprising an inductively coupled conductor, an inductively coupled conductor of the filament preheat module magnetically coupled to the inductively coupled conductor of the inverter to power the filament during preheating, and a switching circuit configured to electrically connect the power from the inductively coupled conductor of the filament preheat module to the filament. The switching module is configured to cutoff the power to the filament from the filament preheat module after a predetermined time period during preheating.

18 Claims, 8 Drawing Sheets

PREHEATING CIRCUIT FOR ELECTRONIC BALLAST

BACKGROUND OF THE INVENTION

The aspects of the present disclosure relate generally to ballasts for powering gas discharge lamps, and in particular to preheat circuits for electronic ballasts used to drive gas-discharge lamps.

DESCRIPTION OF RELATED ART

A gas-discharge lamp belongs to a family of electric lighting or light generating devices that generate light by passing an electric current through a gas or vapor within the lamp. Atoms in the vapor absorb energy from the electric current and release the absorbed energy as light. One of the more widely used types of gas-discharge lamps is the fluorescent lamp which is commonly used in office buildings and homes. Fluorescent lamps contain mercury vapor whose atoms emit light in the non-visible low wavelength ultraviolet region. The ultraviolet radiation is absorbed by a phosphor disposed on the interior of the lamp tube causing the phosphor to luminesce, thereby producing visible light.

Current flow through a fluorescent lamp is generally achieved by placing cathodes at either end of the lamp tube to inject electrons into a vapor within the lamp. These cathodes are structured as filaments that are coated with an emissive material used to enhance electron injection. The emission mix typically comprises a mixture of barium, strontium, and calcium oxides. A small electric current is passed through the filaments to heat them to a temperature that overcomes the binding potential of the emissive material allowing thermionic emission of electrons to take place. When an electric potential is applied across the lamp, electrons are liberated from the emissive material coating on each filament causing a current to flow. While a lamp is in operation, and especially when a lamp is ignited, the emission mix is slowly sputtered off the filaments by bombardment with electrons and mercury ions. Over time, the emission mix is sputtered off of the cathodes in normal operation, but a larger amount is sputtered off when the lamp is ignited with cold cathodes. When the emission mix becomes depleted, a higher voltage is required for the cathodes to emit electrons, a condition sometimes referred to as end-of-life ("EOL"). The higher voltage results in an increase in temperature which may overheat the lamp and in some cases crack the glass if the lamp is not replaced.

Electronic ballasts for gas discharge lamps can be classified as preheat and instant start. In preheat ballasts, the lamp filaments are heated for a limited period of time before a lamp voltage is applied across the lamp to ignite the lamp. In instant start ballasts, the lamp filaments are not preheated, and a higher starting voltage is typically applied to ignite the lamps.

Fluorescent lamps, including compact fluorescent lamps (CFLs), include cathodes (filaments) which are preferably preheated before ignition to extend the operational life of the lamp. Conventional low cost CFL ballasts often use a positive temperature coefficient (PTC) thermistor to heat the lamp cathodes of the lamp prior to ignition (preheat). The PTC is coupled in parallel with a capacitor connected across the CFL, and initially conducts allowing preheating current to flow through the lamp cathodes. With continued conduction, the PTC device heats up and the PTC resistance increases, eventually triggering ignition of the gas in the lamp. The PTC, moreover, is typically situated in close proximity to the lamp to keep the PTC in the high-impedance condition during normal operation of the lamp. However, PTC devices are costly and occupy valuable space in the ballast. In addition, the PTC element never reaches infinite impedance and thus conducts some amount of current throughout operation of the ballast (even if some of the energy to keep the PTC device warm comes from lamp heating). Thus, the use of PTC devices for cathode preheating negatively impacts ballast efficiency. Furthermore, PTC preheating circuits need time to cool before reapplication of power to avoid cold-cathode ignition and the associated lamp degradation. Thus, a need remains for improved ballasts and techniques for preheating fluorescent lamp cathodes without using PTC components.

Accordingly, it would be desirable to provide a preheat circuit for an electronic ballast that resolves at least some of the problems identified above.

SUMMARY OF THE INVENTION

As described herein, embodiments of the present disclosure overcome one or more of the above or other disadvantages known in the art.

An embodiment of the present disclosure relates to a filament preheat module for preheating a filament of a lamp that is powered by a power circuit including an inverter having an inductively coupled conductor. In an embodiment, the filament preheat module includes a winding, the winding of the filament preheat module magnetically coupled to the inductively coupled conductor of the inductor to power the filament during preheating. A switching circuit is configured to electrically connect the power from the winding of the filament preheat module to the filament. The switching module is configured to cutoff the power to the filament from the filament preheat module after a predetermined time period during preheating.

An embodiment of the present disclosure is directed to a circuit for preheating a filament of a lamp. In an embodiment, the circuit includes a filament preheating circuit electrically coupled to the filament, an inverter including a inductively coupled conductor configured to be magnetically coupled to the filament preheating circuit to provide electrical power to the filament, and a switching device configured to enable power to flow from filament preheating circuit to the filament in a preheating stage.

An embodiment of the present disclosure is directed to a ballast for driving a gas discharge lamp. In an embodiment, the ballast includes an inverter configured to generate a lamp supply voltage signal and a filament preheat circuit electrically coupled to an inductively coupled conductor of the inverter and the gas discharge lamp. The filament preheat circuit is configured to preheat a filament of the gas discharge lamp. In an embodiment, the filament preheat circuit includes a winding magnetically coupled to inductively coupled conductor of the inverter, the winding configured to provide electrical power to the filament during preheating. A switching circuit is configured to electrically connect the power from the winding of the filament preheat module to the filament, wherein the switching module is configured to enable power to the filament during preheating and cutoff the power to the filament from the filament preheat module after a predetermined time period during preheating.

These and other embodiments and advantages of embodiments of the present disclosure will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
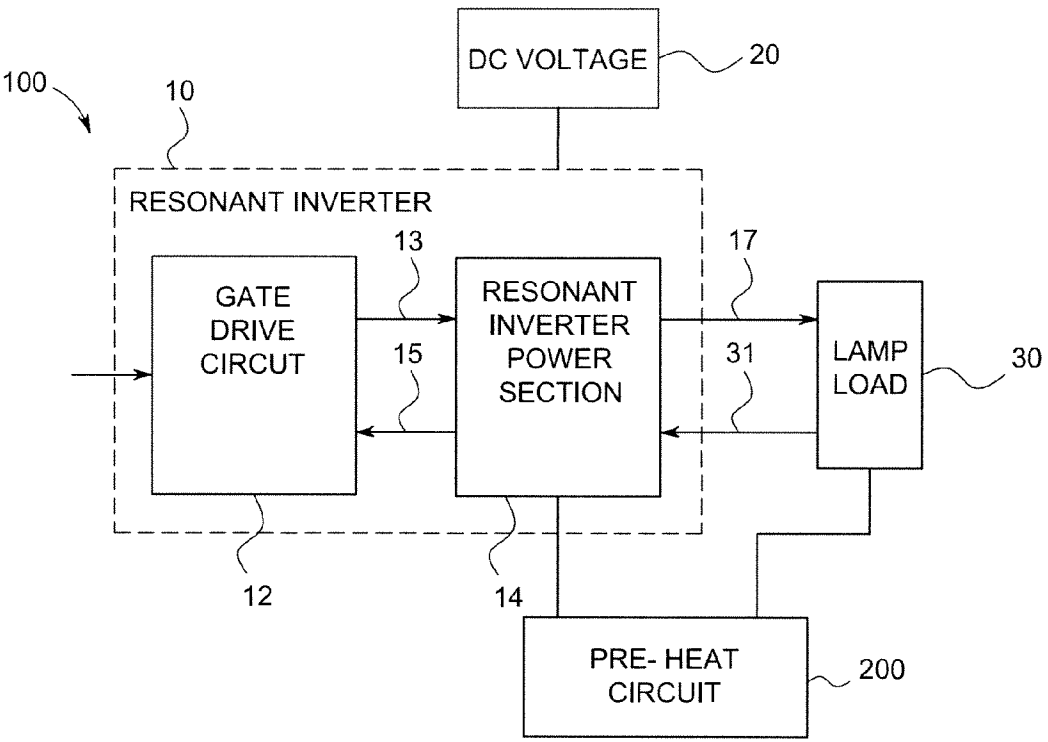
FIG. 1 illustrates a block diagram of an exemplary lighting apparatus including a filament preheating circuit incorporating aspects of the present disclosure.

Referring to FIG. 1, an embodiment of an exemplary lighting apparatus that includes a filament preheat module or preheating circuit incorporating aspects of the disclosed embodiments is generally indicated by reference number 100. The aspects of the disclosed embodiments are generally directed to a filament preheating circuit 200 for an electronic ballast 10 that provides the preheating energy through a inductively coupled conductor or winding coupled with a inductively coupled conductor of the inverter power section 14 of the ballast circuit 10, also referred to herein as the inverter 10. For purposes of the description herein, the inductively coupled conductor will generally include any device that is configured to magnetically couple electrical energy such as an inverter, inductor, transformer or coil.

The filament preheating circuit 200 of the disclosed embodiments does not require a high voltage cutoff switch. Rather, the filament preheating circuit 200 of the disclosed embodiments is powered from a winding of the resonant inductor or transformer of the inverter circuitry of the electronic ballast 10, referred to as the preheat winding, and is cutoff from the inverter power section 14 automatically by a switch signal. The filament preheating circuit 200 of the disclosed embodiments does not need to have a common "reference ground" as does the inverter power section 14, which means it can be equipped with the isolation from the inverter power section 14. The voltage of the preheating winding remains low, typically 5V~10V, thus enabling the use of low voltage, and low cost switching and other components, and also the use of a preheating inductor or transformer in the filament preheat circuit that is built with less copper and smaller core size, such as for example, a ring core transformer.

FIG. 1 illustrates a block diagram of an exemplary lighting apparatus 100 that regulates a high frequency AC voltage 17, also referred to herein as the lamp supply voltage, supplied to a lamp load 30. The illustrated lighting apparatus 100 uses an inverter module 10, such as for example a resonant inverter module, to convert a DC voltage 20 to a high frequency AC voltage that comprises the lamp supply voltage 17 that is used to power the lamp load module 30. The inverter 10, which in this example comprises an exemplary self-oscillating voltage-fed inverter 10, may be advantageously employed in various types of ballasts such as for example, instant start or program start ballasts. Although the aspects of the disclosed embodiments are generally described herein with respect to a resonant inverter module, the aspects of the disclosed embodiments are not so limited and in some embodiments, any suitable inverter can be used.

In the exemplary embodiments described herein, the lamp load module 30 includes one or more gas discharge lamps as well as ballasting components and filament heating circuitry. An inverter power section 14 receives switch gating signals 13, 15, also referred to as gate drive signals, from a gate drive circuit 12 which operates the inverter 10 and adjusts or regulates the frequency of the inverter 10. The preheat circuit module 200 is generally configured to preheat the lamp filaments in the lamp load module 30 by drawing energy from an inductively coupled conductor of the preheat circuit module 220, such as a winding, coupled with an inductively coupled conductor of the inverter power circuit 14, such as for example, an inductor or transformer. The preheat module 200 of the disclosed embodiments eliminates the need for a high voltage cutoff switch and can also be used to provide the preheating energy to multiple lamp filaments.

Figure 2:
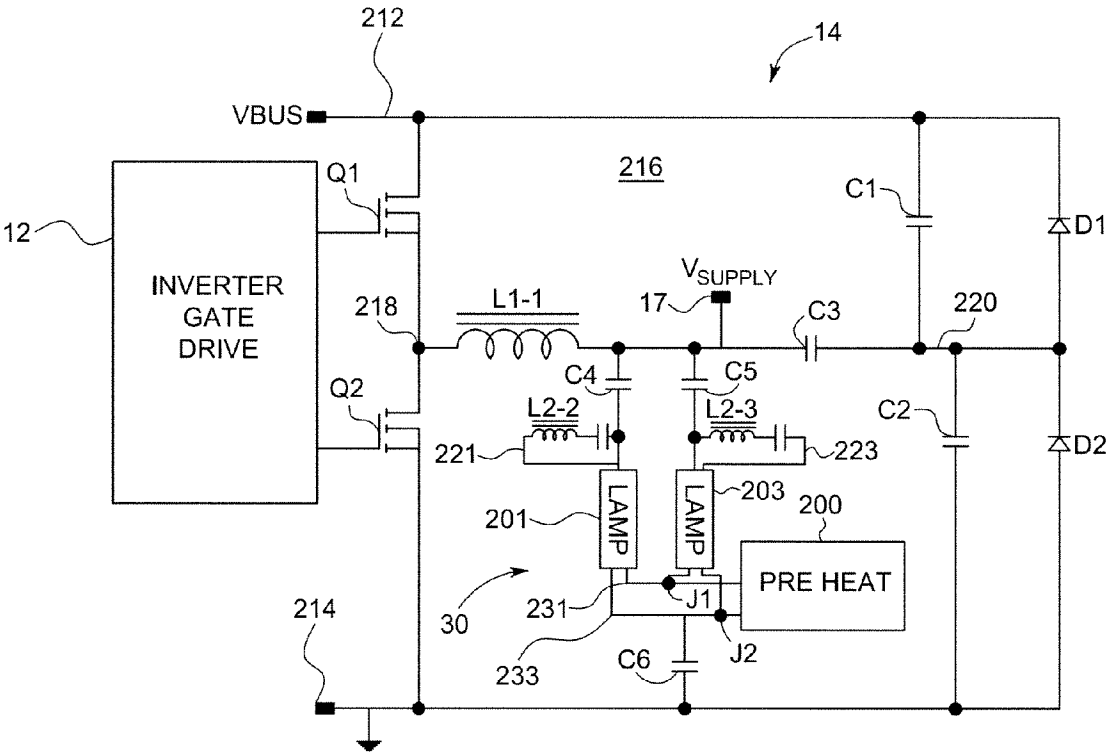
FIG. 2 illustrates an exemplary schematic diagram of an embodiment of an electrical lighting apparatus including a filament preheat circuit module incorporating aspects of the present disclosure.

FIG. 2 is an exemplary schematic diagram illustrates an embodiment of an exemplary inverter power section 14 and preheat module 200 for use in the exemplary lighting apparatus 100 illustrated in FIG. 1. The inverter power section 14, also referred to as a resonant inverter power section, receives the DC input voltage 20 across a positive rail 212 and ground rail 214 and produces the lamp supply voltage 17. In an embodiment, the lamp supply voltage 17 can be in the range of approximately 100 to 120 volts AC. The resonant inverter power section 14 includes a resonant tank circuit, designated generally by numeral 216, and a pair of controlled switching devices Q1 and Q2. In an embodiment, the switching devices Q1 and Q2 comprise n-type metal oxide semiconductor field effect transistors (MOSFETs). In some embodiments, the switching devices Q1, Q2 can comprise any suitable switching device.

The DC input voltage 20 is received onto the positive and ground rails 212, 214 and is selectively switched by switching devices Q1 and Q2 connected in series between the positive rail 212 and ground rail 214. The selective switching of switching devices Q1 and Q2 generally operates to generate a square wave at an inverter output node 218, which in turn excites the resonant tank circuit 216 to thereby drive the lamp supply voltage 17. In an embodiment, the square wave has an amplitude of approximately one-half the DC input voltage 20 at the inverter output node 218. The frequency of the square wave generated at node 218 can be referred to as the frequency of the inverter or as the inverter frequency. In an embodiment, the inverter frequency is approximately 70 kilohertz, although any suitable or desired inverter frequency may be used. The resonant tank 216 includes an inductively coupled conductor L1-1, referred to as resonant inductor L1-1, as well as an equivalent capacitance, generally comprising the equivalent of capacitors C1 and C2 connected in series between the positive rail 212 and the ground rail 214 with a center node 220 coupled to the lamp supply voltage by capacitor C3. A clamping circuit is formed by diodes D1 and D2 individually connected in parallel with the capacitances C1 and C2, respectively. The lamp supply voltage 17 is used to drive the lamp load 30, which in the embodiment of FIG. 2 comprises lamps 201, 203. In some embodiments, the lamp load 30 can include any suitable number of lamps. In an embodiment, a first terminal 221, 223 corresponding to each lamp 210, 203, is respectively connected to the lamp supply voltage 17 through a series connected ballasting capacitor, C4 and C5 respectively. A second terminal 231, 233 corresponding to each lamp 201, 203, is connected to the ground rail 214 through a blocking capacitor C6. Two secondary inductively coupled conductors or windings, L2-2 and L2-3, with filtering capacitors C21 and C23, respectively, are coupled across the filaments of each lamp 201, 203. In a typical circuit, the windings L2-2 and L2-3 would be magnetically coupled to a separate preheating transformer to provide heating current to heat the lamp filaments to allow thermionic electron emissions. The aspects of the disclosed embodiments eliminate the need for such a separate preheating transformer. While the exemplary resonant inverter power section 14 of FIG. 2 illustrates two lamps 201, 203 electrically connected in parallel, the aspects of the disclosed embodiments are not so limited, and are intended to includes alternate lamp configurations such as series connected lamps, a single lamp, more than two lamps, or other combinations of series and parallel connected lamps.

The preheat circuit 200 shown in FIG. 1 is generally configured to preheat the filaments of any of the lamps 201, 203 in the lamp module 30. In an embodiment, the lamp module 30 is part of a programmed start electronic ballast. In some embodiments, the lamp module 30 is part of any suitable electronic ballast. The filament preheating circuit 200 is configured to generate a high frequency preheating voltage that is applied to the filament of any of the lamps 201, 203 in the lamp module 30, as will be described below. As will be described in more detail with respect to FIG. 2 below, the filament preheating circuit 200 draws power from the resonant inductor or transformer L1-1 of the resonant inverter power section 14. The preheat energy can be cutoff automatically by the control switch signals of the preheat circuit 200. The aspects of the disclosed embodiments provide for cutting off the preheat circuit 200 from the main resonant inverter or power section 14 of the resonant inverter 10 when the filament of each lamp 201, 203 in the lamp circuit 30 is suitably heated or after a pre-determined period of time.

FIG. 2 illustrates the application of the preheat circuit module 200 shown in FIG. 1 according to an embodiment. The preheat circuit 200 is shown coupled to the lamp load circuit at terminals J1 and J2. The terminals J1 and J2 are the terminals at one end of either or both of the lamps 201, 203. In an embodiment illustrated in FIG. 2, terminals J1 and J2 are coupled to terminals 231 and 233 of the each lamp 201, 203, respectively. The filament of any of the lamps 201, 203 is across these terminals J1, J2. In this embodiment, two lamps 201, 203 are illustrated. However, it will be understood that in some embodiments, any suitable number of lamps can be included, such as more or less than two.

Figure 3:
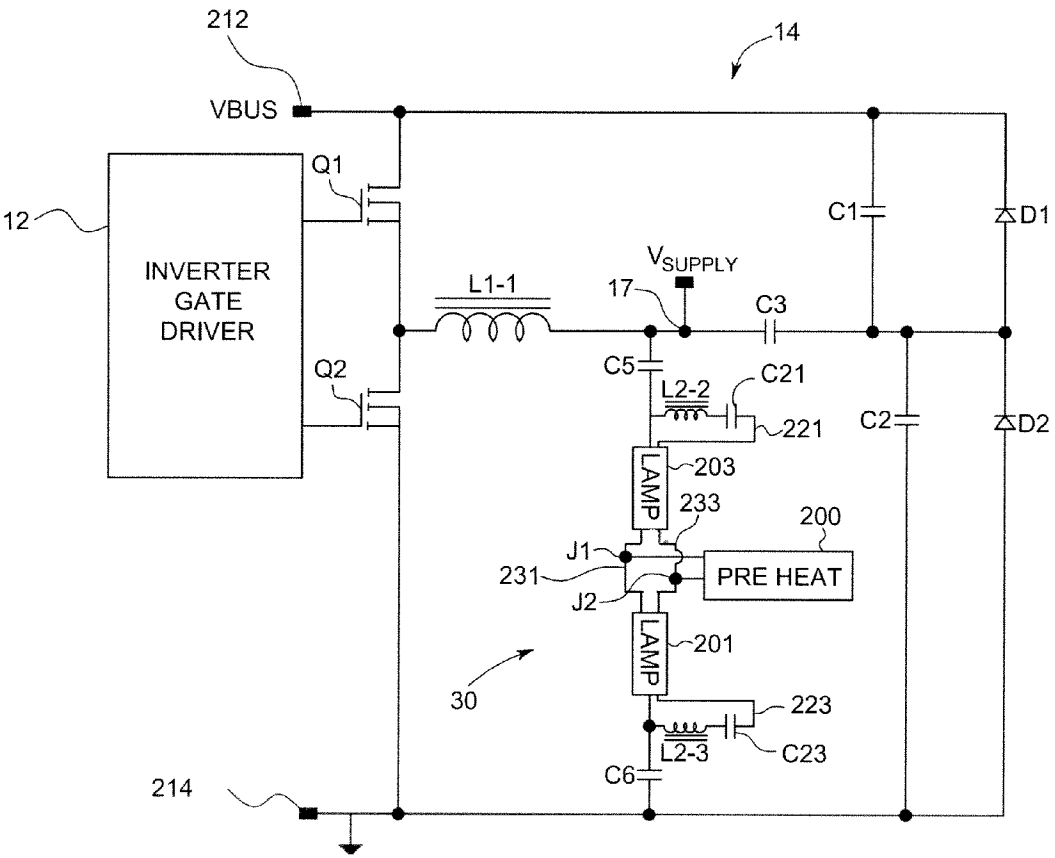
FIG. 3 illustrates an exemplary schematic diagram of an embodiment of an electrical lighting apparatus including a filament preheat circuit module incorporating aspects of the present disclosure

In the embodiment shown in FIG. 2, the lamps 201, 203 are electrically coupled in parallel. FIG. 3 illustrates a circuit similar to that shown in FIG. 2, except that the lamps 201, 203 are electrically coupled in series. The aspects of the disclosed embodiments provide for any suitable number of lamps, such lamps 201, 203, to be electrically coupled in parallel or series.

Figure 4:
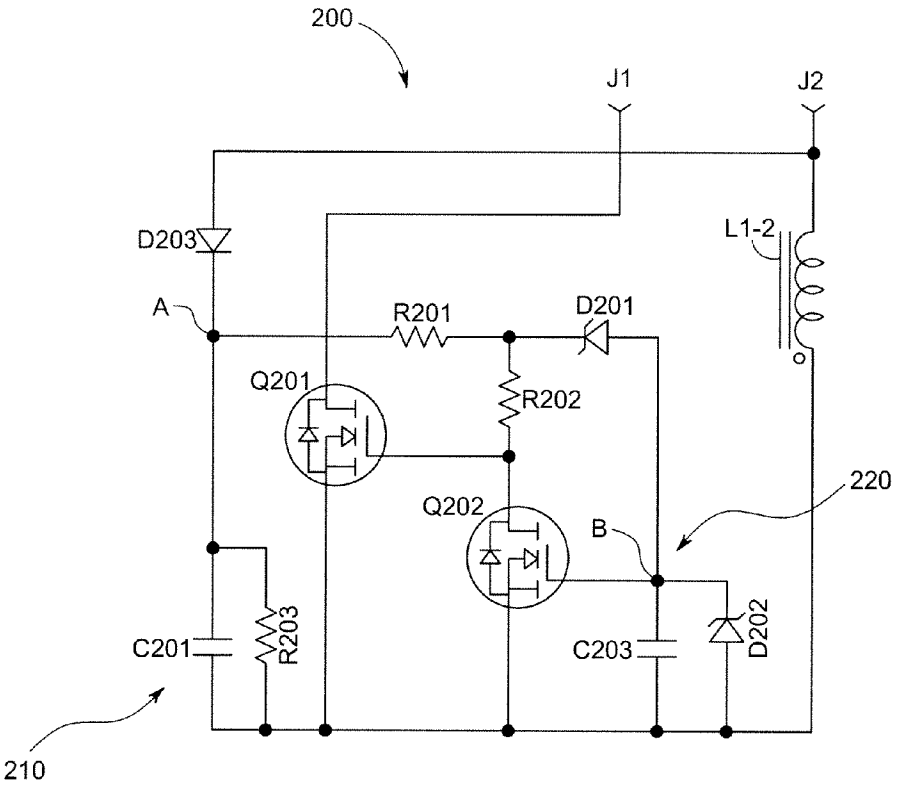
FIG. 4 illustrates a schematic diagram of an embodiment of a filament preheat circuit module incorporating aspects of the present disclosure.

FIG. 4 illustrates a schematic diagram of an embodiment of the preheat circuit 200. The preheat circuit 200 is generally configured to power the filaments of the lamps 201, 203 for a pre-determined period of time, generally referred to as the filament preheat period. At the expiration of the filament preheat period, the preheat circuit 200 is configured to disconnect or "cut-off" the power, also referred to as removing the preheat circuit 200 from the resonant inverter 10 of FIG. 1. By disconnecting the preheat circuit 200 from the resonant inverter 10 after a pre-determined period of time, typically in the range of about 500 milliseconds to 800 milliseconds (ms), the preheat circuit 200 does not consume any further energy and the system 100 shown in FIG. 1 can operate with a higher efficiency.

In this embodiment, the filament preheating circuit 200 is energized by an inductively coupled conductor or winding L1-2 of the resonant inverter power section 14. The winding L1-2 can be taken from a resonant inductor or transformer of the resonant inverter power section 14, such as for example transformer winding L1-1 shown in FIGS. 2 and 3. The transformer winding L1-2 acts as a voltage source and provides the preheat energy to the filaments of lamps 201, 203 shown in FIGS. 2 and 3.

As is illustrated in FIG. 4, the preheat circuit generally comprises a first switch device Q201 and a second switch device Q202. In an embodiment, the first and second switching devices Q201 and Q202 are semiconductor switching devices such as MOSFETS or BJT type switching devices. The switching devices Q201 and Q202 are generally configured to cutoff or disconnect the filaments of the lamps 201, 203 from the power source provided by transformer winding L1-2. In some embodiments, any suitable switching circuits or devices can be used that will electronically disconnect the filaments of lamps 201, 203 from the power source.

In the embodiment shown in FIG. 4, when the first switch Q201 is in an ON state, the energy that is coupled from transformer winding L1-2 is used to heat the filaments of the lamps 201, 203 shown in FIGS. 2 and 3. When the second switch Q202 is in an ON state, the first switch Q201 is switched OFF, which electrically disconnects the preheat circuit 200 from the resonant inverter power section 14. When switch Q201 is switched OFF, the transformer winding L1-2 stops energizing the filament(s) in the lamp circuit module 30 because the transformer winding L1-2 is electrically disconnected from the lamp filaments. In an embodiment, the turn ratio between windings L1-1 and L1-2 can be used to adjust the preheating energy that is provided to the filaments of the lamp circuit module 30.

In an embodiment, a first delay circuit 210 is used to control the switching ON of the switch Q201. The first delay, controlled by the RC timing of the first delay circuit, causes the first switch Q201 to switch ON after a pre-determined time period. For example, once the resonant inverter 10 starts to resonate, and the winding L1-2 of the filament preheat module 200 absorbs the energy coupled from winding L1-1 of the inverter power section 14. The switch Q201 switches ON after a short delay, which is a result of the RC combination of the first delay circuit.

In the example of FIG. 4, the first delay circuit 210 generally comprises devices D203, R201, R202, C201 and R203. In some embodiments, any suitable device or devices can be used to delay the switch of the switch Q201 to the ON state once the winding L1-2 is energized.

A second delay circuit 220 is used to control the switching of device Q202 to the ON state. The second delay, controlled by the RC timing of the second delay circuit 220, causes the switch Q202 to switch to the ON state, which causes switch Q201 to switch OFF. In the example of FIG. 4, the second delay circuit 220 generally comprises elements D203, 8201, D201 and C203. In some embodiments, any suitable device or devices can be used to control the switching ON of the switch Q202 once the winding L1-2 is energized.

When Q201 is ON, Q202 is OFF, and the preheat circuit 200 starts energizing the filaments of lamps 201, 203. Thus, current passes from the preheating circuit 200 through terminals J1, J2 and through the filament of the lamps 201, 203 shown in FIGS. 2 and 3. In an embodiment, the energy that is conducted through the filaments of lamps 201, 203 can be controlled by the turn ratio between L1-2 and L1-1. The length of time of this preheat phase is dependent on the second delay circuit. As noted, the length of time of the preheat phase is in the range of approximately 500 ms to 800 ms. In some embodiments, the length of the preheat phase can be any suitable time. The zener diode D202 may be used to clamp the voltage across the gate and source of Q202. The zener diode D201 sets a reference threshold voltage as the voltage across C203 starts to increase, and D201 may be used in the delay circuit to set the length of the preheat phase.

During the preheating stage, the voltage across capacitor C203 starts to increase until the voltage at circuit node or point A reaches the break down voltage of zener diode D201. When the voltage across C203 reached the threshold voltage of Q202, the switch Q202 will be in the ON state. When Q202 is ON, switching device Q201 is switched to a non-conducting or OFF state. In the OFF state of Q201, the preheating current to the filaments of lamps 201, 203 through terminals J1, J2 is cut-off. This is the end of the preheating stage.

Figure 5:
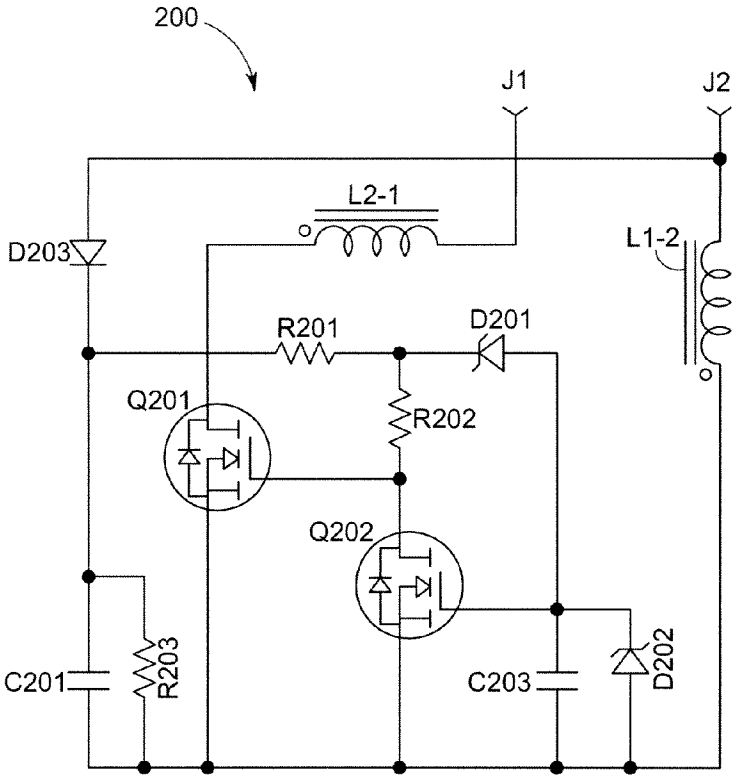
FIG. 5 illustrates a schematic diagram of an embodiment of a filament preheat circuit module incorporating aspects of the present disclosure.
Figure 6:
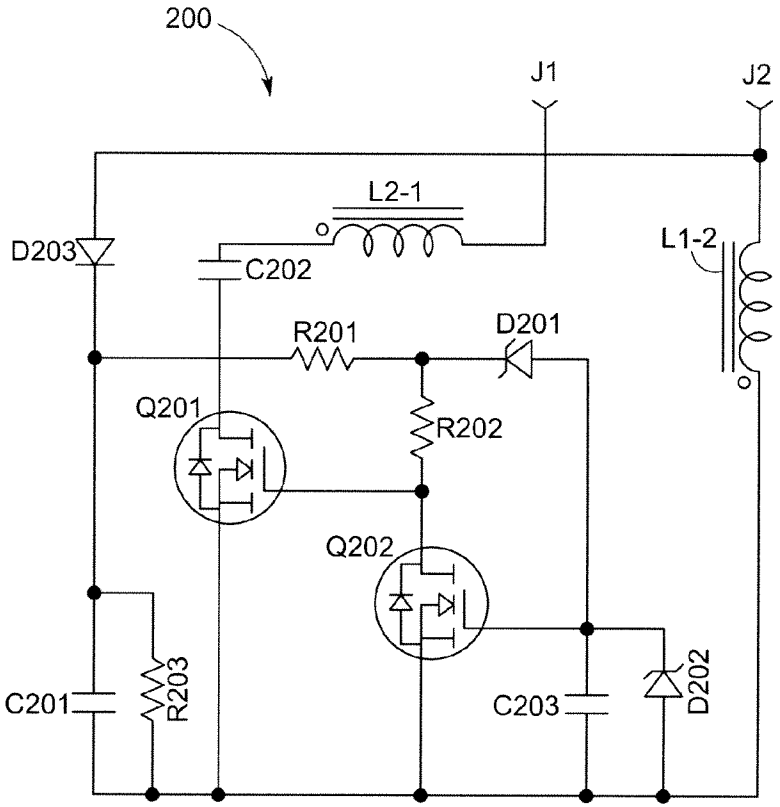
FIG. 6 illustrates a schematic diagram of an embodiment of a filament preheat circuit module incorporating aspects of the present disclosure.
Figure 7:
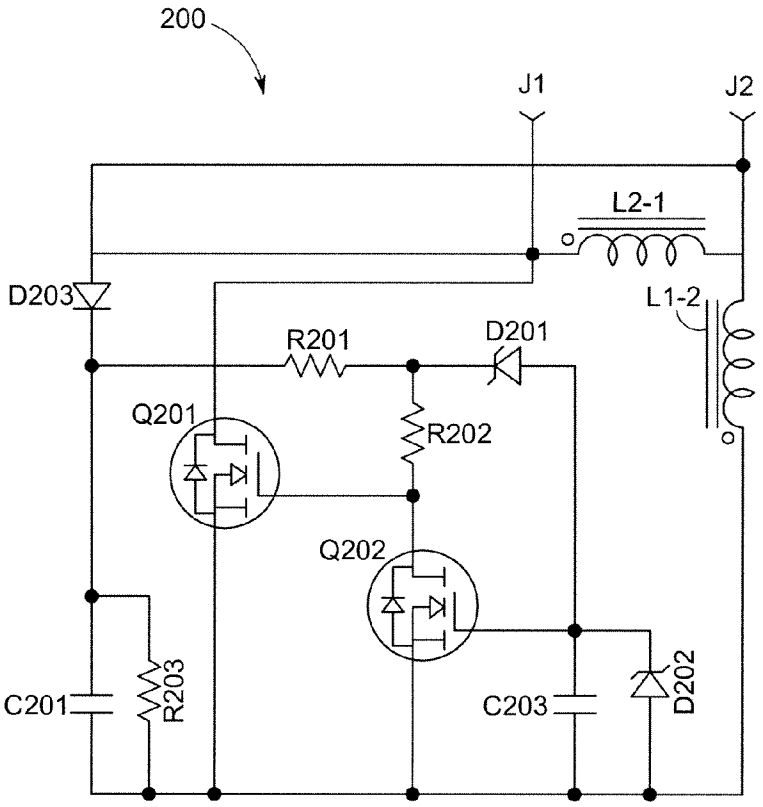
FIG. 7 illustrates a schematic diagram of an embodiment of a filament preheat circuit module incorporating aspects of the present disclosure.

FIGS. 5, 6, and 7 illustrates the insertion of an inductively coupled conductor, referred to herein as the preheating inductor or transformer L2-1, into the preheat circuit 200. The preheating inductor or transformer L2-1 can be used to power other lamp filaments in the lamp load 30. In the example of FIG. 5, the preheating inductor L2-1 is coupled in series between the terminal J1 and the switch Q201. FIG. 6 illustrates the use of a capacitor C202 between the preheating inductor L2-1 and the switch Q201. In the example of FIG. 7, the preheating inductor L2-1 is coupled between the terminals J1 and J2.

In the examples of FIGS. 5, 6, and 7, when switching device Q201 is switched ON, the current will flow through the preheating inductor or transformer L2-1. The preheating inductor or transformer L2-1 can be magnetically coupled with the windings of other lamp circuits to heat the lamp filaments included therein. For example, the inductor or transformer L2-1 can be magnetically coupled with inductor windings L2-2 and L2-3 of FIGS. 2 and 3 to heat those lamp filaments. In the embodiment shown in FIGS. 5-7, the preheating inductor or transformer L2-1 can be a ring core inductor or transformer, which are typically low cost devices.

FIG. 6 illustrates an embodiment of the circuit shown in FIG. 5 with capacitor C202 inserted between the switch Q201 and the inductor L2-1. In this embodiment, the capacitor C202 is used to ballast the current or energy that flows through the filaments of lamps 201, 203 of FIGS. 2 and 3. The capacitor 202 is used to limit the amount of current delivered to the filaments of lamps 201, 203 and is not resonant with one or more of windings L1-2 and L2-1.

Figure 8:
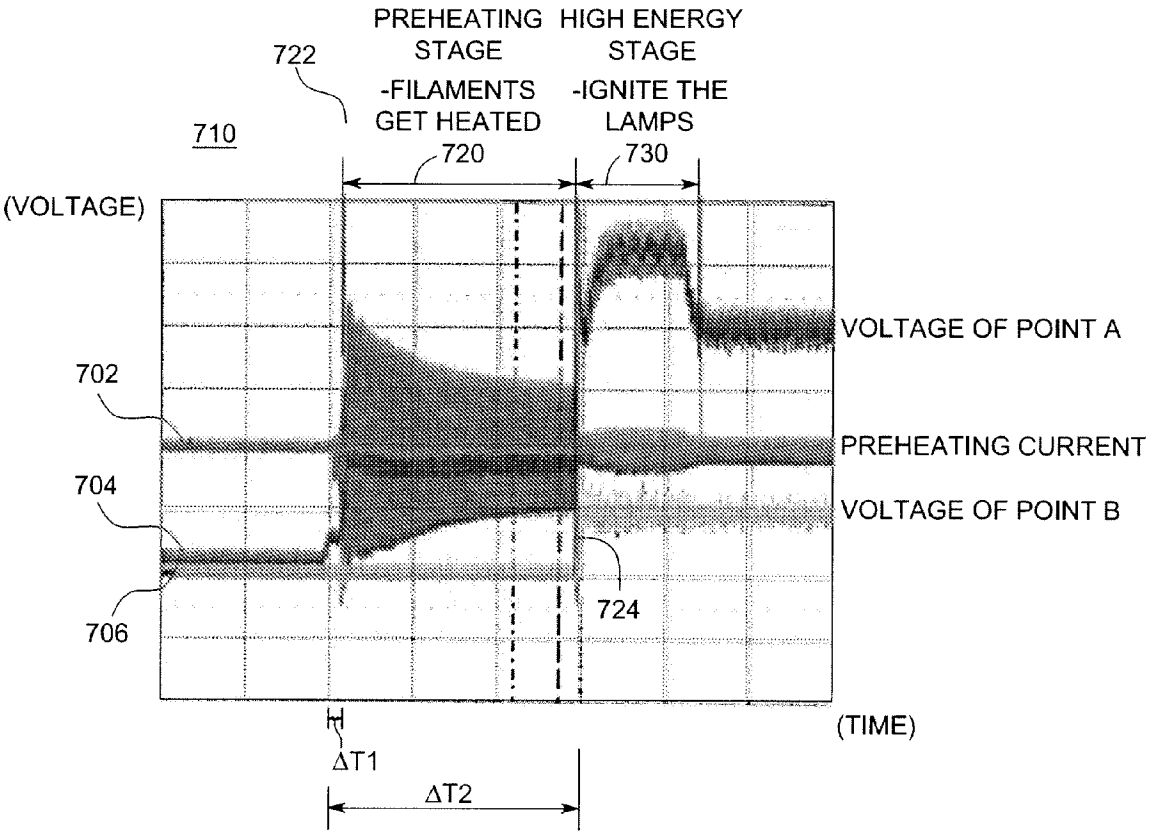
FIG. 8 is a graphical illustration of the simulated relationships between the current delivered to the lamps and the voltages triggering the ON and OFF states of the switching devices in a filament preheat module incorporating aspects of the present disclosure.

FIG. 8 illustrates the simulated relationships between the current through the filaments of each of the lamps 201, 203 shown in FIGS. 2 and 3 and the voltages triggering the ON and OFF states of the switching devices Q201 and Q202 as measured at points A and B of FIG. 4. The preheating current is indicated by line 702, while the voltage at node A is indicated by line 704 and the voltage at node B is indicated by line 706.

As is shown in FIG. 8, in a stage 710 prior to the preheating stage 720, the voltages at points A and B of FIG. 4 are approximately the same, as indicated by references lines 704, 706. At point 722 the preheating stage 720 is initiated and the winding L1-2 of FIG. 4 is energized by the resonant inverter 10. After a short delay, indicated by ΔT1, the voltage at node A increases above the threshold voltage of Q201, the switching device Q201 turns ON, while switching device Q202 is OFF at the end of the time period ΔT2, the end of the preheating stage 720, the voltage at node B increases above the threshold voltage of Q202, and Q202 is in the ON state. This causes switching device Q201 to switch OFF. Since Q202 is in an ON state and switching device Q201 is OFF, or open, the preheating circuit 200 is in the open condition, and the preheating circuit 200 is cutoff from the lamp circuit module 30 at approximately point 724 in FIG. 7. The resonant inverter 10 of FIG. 1 will produce one high voltage to ignite the lamps of the lamp load 30 when reaching the cutoff point, which is indicated in the high energy state 730. The voltage at point A in FIG. 4 will be proportionally increasing with the high voltage, however, the voltage at point B in FIG. 4 will be clamped at the break down voltage of zener diode D202.

The aspects of the disclosed embodiments provide preheating energy from a winding of the preheat circuit that is magnetically coupled to a winding of the resonant inductor or transformer. Since the preheat circuit draws power from the resonant inductor or transformer and can be configured with isolating from the resonant inverter, a high voltage switch is not required The preheating transformer could be equipped with less copper and smaller core size, using for example a low cost ring core transformer. The preheat energy can be cutoff automatically from the resonant inverter by the switch signal. The preheating current to the lamp filaments generally approximates a standard sine (or cosine) wave signal, which produces less electromagnetic interference, than a pulse wave signal used to ignite ballasts. The preheat circuit uses less components, is low cost and can be used for example, in a programmed start electronic ballast.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit and scope of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A filament preheat module for preheating a filament of a lamp that is powered by a power circuit comprising an inverter for powering the lamp, the inverter comprising an inductively coupled conductor, the filament preheat module comprising:

an inductively coupled conductor, the inductively coupled conductor of the filament preheat module magnetically coupled to the inductively coupled conductor of the inverter, to power the filament during preheating; and a switching circuit configured to electrically connect the power from the inductively coupled conductor of the filament preheat module to the filament, wherein the switching module is configured to cutoff the power to the filament from the filament preheat module after a predetermined time period during the preheating, wherein the switching circuit comprises:

a first switch coupled to the filament and configured to enable a current flow through the filament from the inductively coupled conductor of the filament preheat module in a conducting state;

a second switch configured to control a state of the first switch between the conducting state and a non-conducting state; and a delay circuit coupled to the second switch and configured to control a state of the second switch between a conducting and a non-conducting state.

2. The filament preheat module of claim 1, wherein each of the first switch and the second switch is a MOSFET device or a BJT device.

3. The filament preheat module of claim 1, wherein the conducting state of the first switch is a filament preheating stage of the filament preheating circuit and the non-conducting state of the first switch is a cutoff stage.

4. The filament preheat module of claim 1, wherein a delay circuit is configured to enable a conducting state of the second switch at the end of the predetermined period of time during the preheating.

5. The filament preheat module of claim 1, wherein during the preheating the switching circuit enables a preheating state of the filament preheat module.

6. The filament preheat module of claim 1, wherein the switching device comprises a first switching device configured to control flow of current through the filament and a second switching device configured to control the first switching device, a control of the second switching device electrically coupled to a delay circuit configured to switch the second switching device to a conducting state at the end of the predetermined time period.

7. The filament preheat module of claim 6, wherein the first switching device and the second switching device are MOSFET or BJT devices, and the second switching device switches to the conducting state when a gate-to-source voltage of the second switching device exceeds a pre-determined threshold voltage supplied by the delay circuit.

8. The filament preheat module of claim 1, further comprising a preheating inductor coupled to the switching circuit and configured to be magnetically coupled to an inductively coupled conductor of another lamp to power the another lamp.

9. The filament preheat module of claim 8, wherein the preheating inductor is electrically coupled across the filament of the lamp.

10. The filament preheat module of claim 8, wherein the preheating inductor is electrically coupled between the switching circuit and the filament of the lamp.

11. The filament preheat module of claim 10, further comprising a capacitor device electrically coupled in series between the switching circuit and the preheating inductor.

12. A circuit for preheating a filament of a lamp, the circuit comprising:

a filament preheating circuit electrically coupled to the filament;

a resonant inverter comprising a resonant inductor or a transformer magnetically coupled to the filament preheating circuit to provide electrical power to the filament; and a switching device configured to enable power to flow from the filament preheating circuit to the filament in a preheating stage, wherein the switching device comprises:

a first switch coupled to the filament and configured to enable a current flow through filament in a conducting state;

a second switch configured to control a state of the first switch between the conducting state and a non-conducting state;

a delay circuit coupled to the second switch and configured to control a state of the second switch between a conducting state and a non-conducting state.

13. The circuit of claim 12, wherein the delay circuit is configured to switch the state of the second switch to the conducting state at the end of a predetermined time period and interrupt the flow of power from the first switch through the filament.

14. The circuit of claim 12, further comprising a transformer winding, the transformer winding magnetically coupled to a winding of the resonant inverter, wherein the switching device comprises a first switch, the transformer winding configured to provide electrical power to the filament in a conducting state of the first switch.

15. The circuit of claim 14, wherein the resonant inverter comprises a resonant inductor and the transformer winding is magnetically coupled to the resonant inductor.

16. The circuit of claim 14, wherein the switching device further comprises a second switch configured to interrupt an electrical connection between the first switch and the filament in a conducting state of the second switch.

17. The circuit of claim 16, wherein the delay circuit is further configured to enable the conducting state of the second switch after a pre-determined time period.

18. A ballast for driving a gas discharge lamp, the ballast comprising:

an inverter configured to generate a lamp supply voltage signal; and a filament preheat circuit electrically coupled to the inverter and the gas discharge lamp, the filament preheat circuit configured to preheat a filament of the gas discharge lamp, the filament preheat circuit comprising:

inductively coupled winding magnetically coupled to the inverter, the inductively coupled winding configured to provide electrical power to the filament during preheating; and a switching circuit configured to electrically connect the power from the inductively coupled conductor of the filament preheat module to the filament, wherein the switching circuit is configured to enable power to the filament during preheating and cutoff the power to the filament from the filament preheat module after a predetermined time period during preheating, wherein the switching circuit comprises:

a first switch coupled to the filament and configured to enable a current flow through filament in a conducting state;

a second switch configured to control a state of the first switch between the conducting state and a non-conducting state; and a delay circuit coupled to the second switch and configured to control a state of the second switch between a conducting state and a non-conducting state.

* * * * *